United States Patent [19]

Hauschopp

[11] 4,272,130

[45] Jun. 9, 1981

[54] MINERAL MINING INSTALLATION

[75] Inventor: Alois Hauschopp, Werne, Fed. Rep. of Germany

[73] Assignee: Gewerkschaft Eisenhutte Westfalia, Lunen, Fed. Rep. of Germany

[21] Appl. No.: 110,696

[22] Filed: Jan. 9, 1980

[30] Foreign Application Priority Data

Jan. 10, 1979 [DE] Fed. Rep. of Germany ..... 2900661

[51] Int. Cl.[3] ..... E21C 27/32

[52] U.S. Cl. ..... 299/34; 299/43

[58] Field of Search ..... 299/34, 42, 43

[56] References Cited

U.S. PATENT DOCUMENTS

| | | | |
|---|---|---|---|
| 2,823,908 | 2/1958 | Rösler | 299/34 |
| 3,151,912 | 10/1964 | Herrmann | 299/34 |
| 4,154,479 | 5/1979 | Braun | 299/43 |

FOREIGN PATENT DOCUMENTS

| | | | |
|---|---|---|---|
| 1179167 | 10/1964 | Fed. Rep. of Germany | 299/34 |
| 2704809 | 8/1978 | Fed. Rep. of Germany | 299/34 |
| 2712486 | 9/1978 | Fed. Rep. of Germany | 299/34 |

*Primary Examiner*—William F. Pate, III

*Attorney, Agent, or Firm*—Thompson, Birch, Gauthier & Samuels

[57] ABSTRACT

A plough for winning material in a longwall working is formed with guide surfaces which co-operate with a guide provided at the face-side of a longwall conveyor. The plough is driven by means of a chain passing round a pair of sprockets positioned at the ends of the conveyor at the goaf-side thereof. The plough is provided with a sword plate which passes underneath the conveyor, and the sword plate is provided with a coupling member for engaging the plough drive chain. the plough includes a plough body provided with cutters at one end thereof. The coupling member is set back relative to said cutters by a sufficient distance to enable the plough to win material up to the appropriate end sprocket when the plough is moving in such a direction that said cutters are leading cutters.

19 Claims, 5 Drawing Figures

MINERAL MINING INSTALLATION

BACKGROUND TO THE INVENTION

This invention relates to a plough for winning material in a longwall working, and to a mineral mining installation incorporating such a plough.

A conventional mineral mining installation consists of a scraper chain conveyor positioned alongside a longwall face, and a plough driven along a guide at the face-side of the conveyor by an "endless" chain. The chain may be accommodated in guide channels defined within the guide. Alternatively, the chain may be accommodated in channels in a chain guide positioned at the goaf-side of the conveyor, in which case the plough is attached to the chain by means of a sword plate which passes underneath the conveyor. In either case, the chain passes over sprockets mounted on the drive frames at the two ends of the conveyor. At least one of these plough driven chain end sprockets is provided with a drive unit.

The disadvantage of these conventional installations is that it is not possible for the plough to mine material from the entire length of a longwall face. It is necessary, therefore, to mine material from the longwall face ends (the so-called "stable-holes") either manually or by means of special stable-hole ploughs, which considerably increase the cost of the installation. These stable-holes actually need to be cut away to a greater depth than that by which the face itself is worked, in order to accommodate the heavy and bulky drive units for the main plough and the conveyor.

A swordless plough is known which can win material over the entire length of a longwall face without the aid of a stable-hole plough. The drive chain for this plough is attached to the central region of the plough body, so that cutters mounted at the two ends of the plough body can win material up to the sprocket wheels mounted on the drive frames at the two ends of the associated conveyor. Unfortunately, the drive unit(s) for this type of plough cannot be attached to the side plate(s) of the drive frame(s). This results in the plough drive unit(s) being attached to the free end(s) of the drive frame(s) which results in added congestion to the already crowded longwall working/roadway interface(s). Moreover, the plough guide must be angled away from the conveyor in the end regions so as to permit the plough drive chain to pass from the end sprockets to the channels in the face-side guide. (see DE OS No. 2 704 809).

The aim of the invention is to provide a mineral mining installation for winning material in a longwall working which enables the entire length of the longwall to be mined by a single plough, without the need for additional plant or expense to win material in the stable-hole regions, and which does not suffer from the disadvantages of the known installations.

SUMMARY OF THE INVENTION

The present invention provides a plough for winning material in a longwall working, the plough being formed with guide surfaces which, in use, co-operate with a guide provided at the face-side of a longwall conveyor, the plough being drivable by means of a plough drive chain passing round a pair of sprockets positioned, in use, at the ends of the conveyor at the goaf-side thereof, the plough being provided with a sword plate which passes, in use, underneath the conveyor, and the sword plate being provided with a coupling member for engaging the plough drive chain, wherein the plough is constituted by a plough body provided with cutters at one end thereof, and wherein the coupling member is set back relative to the cutters by a sufficient distance to enable the plough to win material up to the appropriate end sprocket when the plough is moving in such a direction that the cutters are leading cutters.

With this plough, therefore, mineral material can be won right up to the said end sprocket, so that there is no need for a stable-hole at that end.

Preferably, the plough is constituted by two longitudinally-spaced plough bodies each of which is provided with cutters at one end thereof, each plough body being provided with a sword plate which passes, in use, underneath the conveyor, and each sword plate being provided with a coupling member for engaging the plough drive chain, the two coupling members being adjacent to one another and being interconnected, wherein each coupling member is set back relative to the cutters of its plough body by a sufficient distance to enable the plough to win material up to the appropriate end sprocket when the plough is moving in such a direction that said cutters are leading cutters. In this case, the plough can win material right up to both end sprockets, so that the entire longwall face can be won without the need to provide stable-holes.

Advantageously, one plough body, sword plate and coupling member combination is a mirror-image of the other plough body, sword plate and coupling member combination.

Preferably, the or each sword plate extends over only part of the length of its plough body, and is spaced from the cutters of that plough body. This enables the plough to be driven along the drive frames of the conveyor without being hindered by the end sprockets mounted thereon. The or each sword plate may taper from its plough body towards its coupling member.

The invention also provides a mineral mining installation for winning material in a longwall working, the installation comprising a longwall conveyor, a guide provided at the face-side of the conveyor, a drive frame at each end of the conveyor, a plough movable along the guide, and a plough drive chain for driving the plough, the plough drive chain passing round a pair of end sprockets positioned at the goaf-side of the conveyor, each end sprocket being associated with a respective one of the drive frames wherein the plough is as defined above.

Advantageously, the or each coupling member is set back relative to the cutters of its plough body by a distance which is greater than the distance between the appropriate end sprocket and the free end of its drive frame. This ensures that winning can occur right up to the roadway ends of the drive frames.

The guide may be constituted by a plurality of generally L-shaped guide sections, one arm of each L-shaped guide section being attached to the conveyor and the other arm of that guide section extending towards the face to be won, and the guide may be formed with a guide passage which opens out towards the floor of the working, the guide passage being formed by recesses in the guide sections, the recesses being formed at the apices of the guide sections. Advantageously, the or each plough body is provided with at least one guide element which engages in the guide passage. Preferably, the or each plough body is provided with two guide elements which engage in the guide passage, the two guide elements being positioned at the ends of that plough body.

The plough guide may be provided with an upwardly-extending projection, and the or each plough body is shaped to engage around this projection.

Preferably, the plough guide extends over the entire length of the conveyor and over substantially the entire length of each of the drive frames.

BRIEF DESCRIPTION OF THE DRAWINGS

A mineral mining installation incorporating a plough constructed in accordance with the invention will now be described, by way of example, with reference to the accompanying drawings, in which.

DESCRIPTION OF PREFERRED EMBODIMENTS

Figures 1, 2, 3:
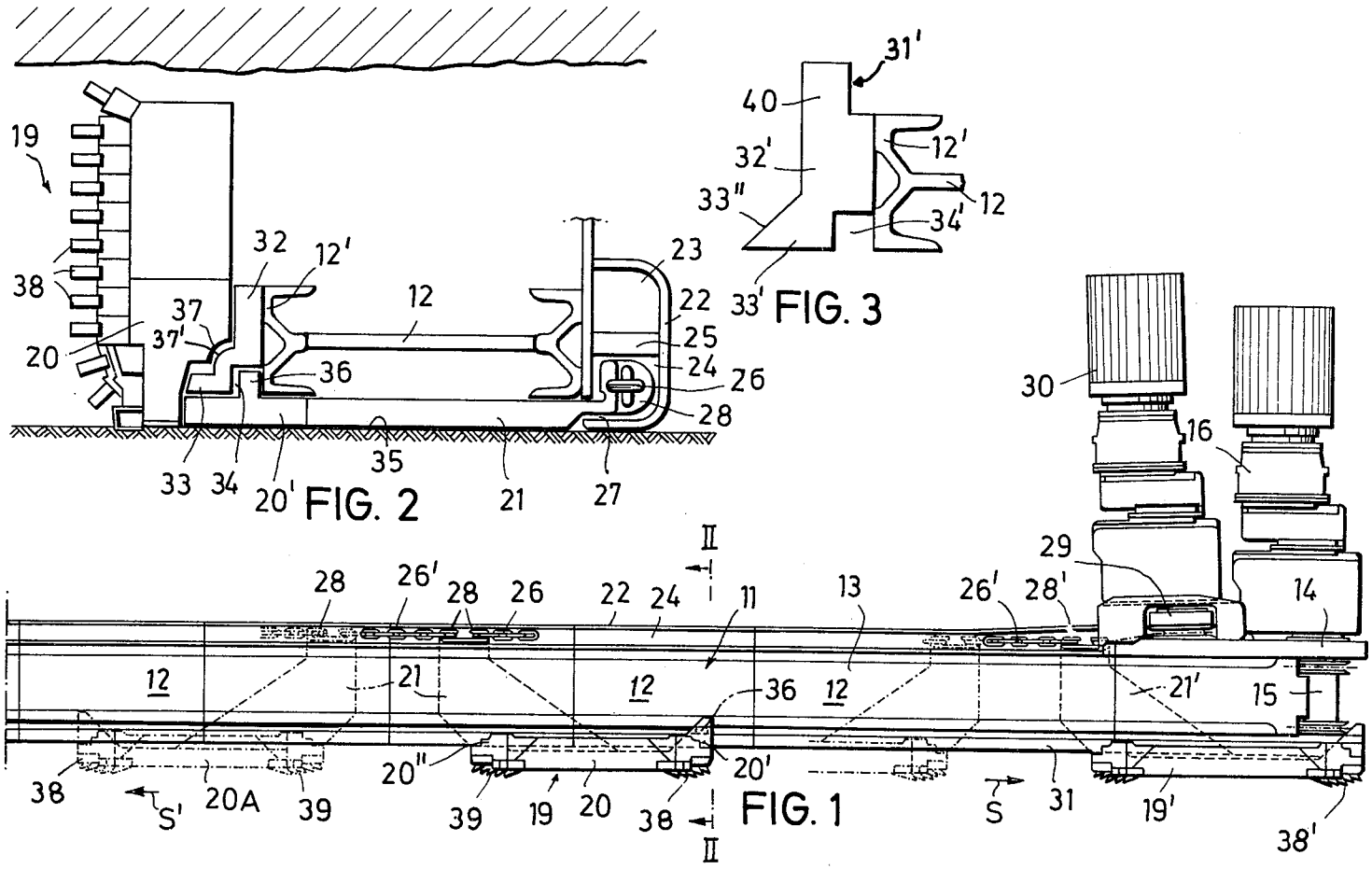
FIG. 1 is a plan view of one end portion of the installation.
FIG. 2 is a cross-section taken on the line II—II of FIG. 1.
FIG. 3 is a cross-section, similar to that of FIG. 2, but showing part of a modified form of plough guide.
Figures 4, 5:
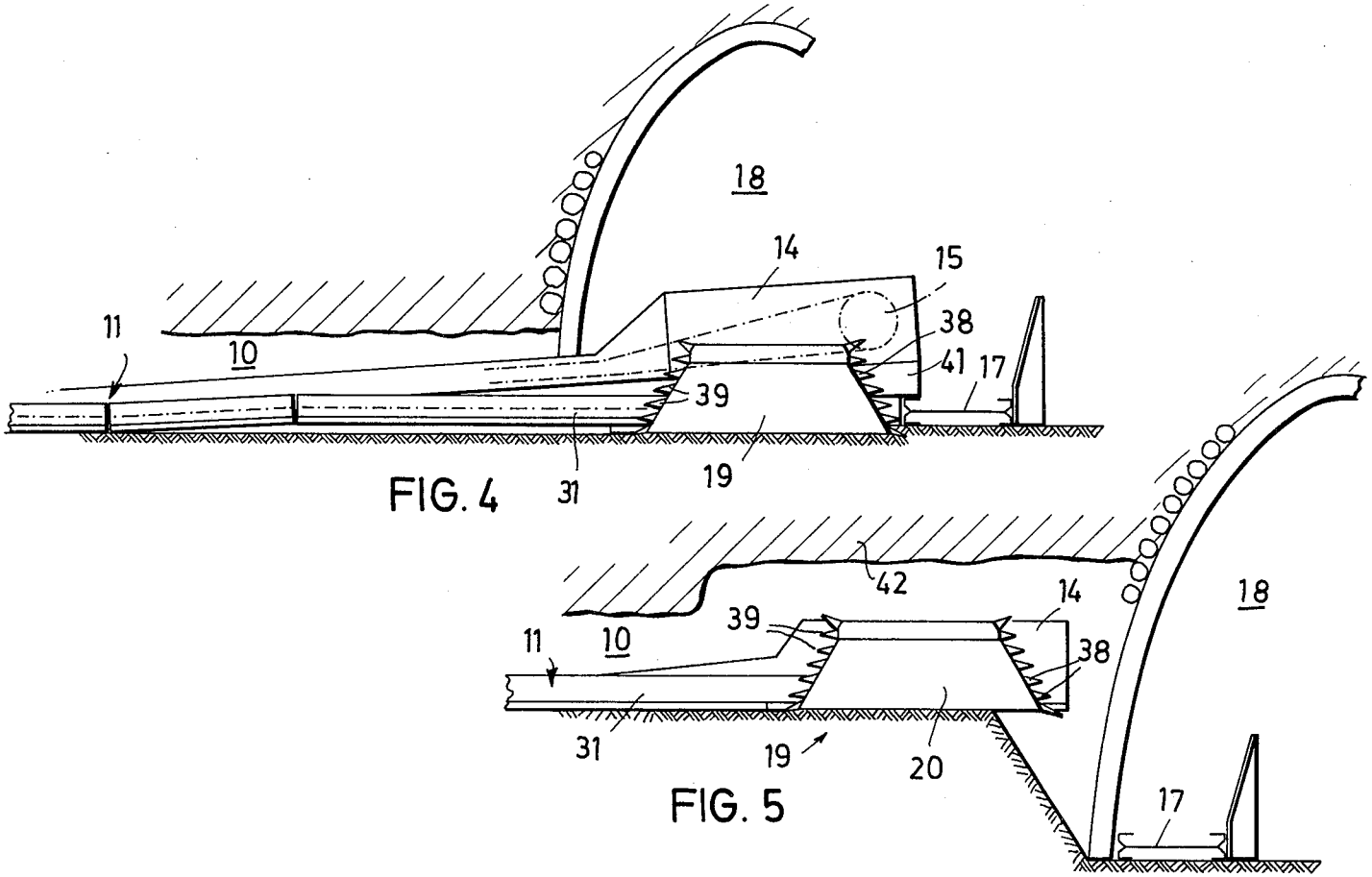
FIG. 4 is a side elevation of said one end of the installation with its drive station positioned in the adjacent roadway.
FIG. 5 is a side elevation similar to that of FIG. 4 but showing the drive station in the longwall working.

Referring to the drawings, FIG. 1 shows a scraper-chain conveyor 11 positioned adjacent to a longwall face (not shown) of a longwall working 10 (see FIGS. 4 and 5). The scraper-chain conveyor 11 consists of a plurality of individual channel sections 12 joined end-to-end. The channel sections 12 are pivotally connected to one another in such a manner as to permit limited relative movement in any direction. A drive frame 14 is provided at one end of the conveyor 11, the drive frame being joined to the conveyor by means of a connector section 13. The drive frame 14 supports a main drive drum 15 for driving the chain or chains of the conveyor 11. The drum 15 is driven by a main drive unit 16 which is flanced on the goaf-side side plate of the drive frame 14. The other end (not shown) of the conveyor 11 is also provided with a drive drum, a drive frame and a connector section, but in this case the drive frame is provided with an auxiliary drive unit. The conveyor 11 discharges won coal (or other mineral material) onto a roadway conveyor 17 provided in the roadway 18 at the main drive end of the conveyor.

A sword-plough 19, having a plough body 20 and a sword plate 21, is provided on the face side of the conveyor 11, the sword plate passing underneath the conveyor and engaging a plough drive chain 26 housed within a chain guide 22 attached to the goaf side of the conveyor. The chain guide 22 defines upper and lower passages 23 and 24 respectively for the upper, return run and the lower, traction run of the drive chain 26. The passages 23 and 24 are separated by spacers 25. The lower passage 24 is provided with a lateral opening 27 through which the sword plate 21 extends. The sword plate 21 is attached to the drive chain 26 in the lower passage 24 by means of a coupling member 28. The coupling member 28 also constitutes a guide block for assisting with the guidance of the plough 19. The drive and reversal of the drive chain 26 is effected by means of sprocket wheels 29 (only one of which is shown in the drawings) which are arranged at the ends of the conveyor 11. The sprocket wheel 29 shown is the main sprocket wheel and is mounted on the goaf-side side plate of the main drive frame 14. This sprocket wheel 29 is driven by a main plough drive unit 30. A similar, auxiliary drive is provided at the other end of the conveyor.

A plough guide 31 is provided at the face side of the conveyor 11, the guide being formed in sections 32 which correspond to the channel sections 12 of the conveyor. Each guide section 32 is attached to the face-side side plate 12' of the corresponding channel section 12. Each guide section 32 is generally L-shaped (see FIG. 2) with a horizontal foot portion 33 and an indented portion at the corner of the L. This results in the formation of a groove 34 at the corner of the L, the groove 34 being open towards the floor 35 of the working 10 and constituting a guide passage for the plough 19. The plough body 20 is shaped to grasp the foot portions 33 of the guide sections 32 and has a part 20' provided with a guide element 36 which engages within the groove 34. The body part 20' is arranged at the leading end of the plough body 20 when the plough 19 is moving in the direction of the arrow S (see FIG. 2). Thus the leading end of the plough 19 is positively guided, in the lateral directions, at the face side of the conveyor. Moreover, the plough 19 is guided, in the vertical direction, by means of a guide surface 37 which engages a complementary surface 37' on the guide sections 32.

As can be seen in FIG. 1, the sword plate 21 extends only part way along the length of the plough body 20. Moreover, the sword plate 21 tapers towards the goaf of the working 10 so that, at the goaf side of the conveyor 11, its width corresponds to the length of the coupling member 28.

The leading end (when the plough 19 is moving in the direction of the arrow S) of the plough body 20 is provided with a plurality of cutters 38 which are arranged vertically in echelon formation. As the coupling member 28 of the sword plate 21 is set back, in the direction S of plough travel, by about the entire length of the plough body 20, the cutters 38 can move alongside the drive frame 14 as the plough 19 approaches the end of its cutting run in the direction S. FIG. 1 shows the end position of the plough 19 (shown here in dashed lines as 19'), in which the coupling member (shown here in dashed lines as 28') is situated close to the sprocket wheel 29. However, because of the length of the plough body 20, the cutters (shown here in dashed lines as 38') at the leading end of the plough are situated in the region of the main chain drum 15. Consequently, the plough 19 can win coal right up to the free end of the drive frame 14. Obviously, the plough guide 31 extends along the connector section 13 and the face-side side plate of the drive frame 14 to enable the plough 19 to move along to the end position 19'.

As described above, the plough 19 is positively guided, at the face side of the conveyor 11, by the guide 31, and, at the goaf side of the conveyor, by the engagement of the coupling member 28 within the lower chain passage 24. It would be possible, however, for the coupling member 28 to be arranged on an extension of the sword plate 21. It is also possible to provide positive guidance for the trailing end of the plough body 20, by providing the trailing end with a part 20'' which corresponds to the part 20'. This part 20'' is also provided with a guide element (not shown but similar to the guide element 36) which engages within the groove 34. In this case, it may be possible to dispense with the additional guidance provided by the sword plate 21 within the goaf-side chain passage 24.

In order that the plough 19 can win coal when it moves in the direction of the arrow S' opposite to that of the arrow S, it is provided with a second plough body 20A which forms a symmetrical mirror image of the first plough body 20. The plough body 20A has a sword plate 21 which passes underneath the conveyor 11 to engage with the plough drive chain 26 via a coupling member 28. The leading end of the plough body 20A (when the plough 19 is moving in the direction of the arrow S') is also provided with a plurality of cutters 38 arranged vertically in echelon formation. The coupling members 28 of the two plough bodies 20 and 20A are joined together by means of a short chain 26'. The two plough bodies 20 and 20A are, therefore, of similar construction. Accordingly, the leading end of the plough body 20A is provided with a guide element (not shown, but similar to the guide element 36) which engages within the groove 34.

The adjacent, facing ends of the two plough bodies 20 and 20A are provided with additional cutters 39. The cutter arrangement is such that, when the plough 19 moves in the direction of the arrow S, the cutters 38 of the plough body 20 and the cutters 39 of the plough body 20A perform the winning work; and, when the plough moves in the direction of the arrow S', the cutters 38 of the plough body 20A and the cutters 39 of the plough body 20 do the winning. Obviously at the other end (not shown) of the conveyor 11, the plough body 20A can be moved sufficiently far along the conveyor to enable the cutters 38 on its leading end to win coal right up to the end of the drive frame situated at that end of the conveyor. Consequently, the plough 19 can win coal over the entire length of the longwall face.

FIG. 4 shows the end of the longwall installation with its main drive station (the drive frame 14 and the drive units 16 and 30) positioned in the roadway 18. Here, the floor of the roadway 18 is at the same level as the floor of the seam being won. Thus, the drive frame 14 needs to be propped up, using chocks 41, so that the delivery end of the conveyor 11 is sufficiently elevated to ensure an adequate discharge height from the conveyor 11 to the roadway conveyor 17, the plough guide 31 also reaches into the roadway 18, so that the plough 19 can be driven into the roadway.

FIG. 5 shows the same end of the installation as FIG. 4, but here the main drive station is positioned in the longwall working 10 at the end thereof. Also, the floor of the working 10 is higher than that of the roadway 18, so there is an adequate discharge height between the two conveyors 11 and 17 without having to prop up the drive frame 14. Where the seam being won has only a small height, it is advisable to cut away the roof 42 of the working 10 in the region of the drive station (as shown in FIG. 5).

FIG. 3 shows an alternative form of guide 31' which is constituted by a plurality of guide sections 32'. Each guide section 32' has an upwardly-extending projection 40. The projections 40 extend upwardly beyond the side plates 12' of the conveyor channel sections 12, and the tops of the plough bodies 20 and 20A are modified so as to define hook-shaped guide portions which grasp the projections. In this way, the upper part of the plough 19 positively guided. The lower part of the plough 19 is guided in a similar manner to that of the embodiment of FIGS. 1 and 2. Thus, the plough bodies 20 and 20A are provided with upwardly-extending guide elements 36 which engage within a guide passage 34' formed at the corners of the generally L-shaped guide sections 32'. The horizontal foot portion 33' of each guide section 32' has an inclined guide surface 33'' which cooperates with complementary guide surfaces (not shown) on the plough bodies 20 and 20A.

One important advantage of the plough 19 is that, owing to the positive guidance of the plough at both the leading and trailing ends at the face-side, secure guidance results in all operational conditions. The positive guidance at the goaf-side enhances this secure guidance.

In order to prevent the heavy drive stations being lifted up by the sword plates 21 pushing themselves under the drive frames 14, the drive units 16 and 30 can be propped up sufficiently to enable the sword plates to slide beneath the drive frames. Alternatively, the drive frames 14 themselves can be directly propped up.

Owing to its shorter length and tapering configuration, each sword plate 21 has a relatively small area for sliding engagement beneath the conveyor 11. Consequently, frictional losses are reduced to a minimum.

Obviously, the installation described above could be modified in a number of ways. For example, the sword plates 21 need not slide along beneath the drive frames 14.

I claim:

1. A mineral mining installation for winning material in a longwall working, comprising: a longwall conveyor; a guide provided at the face-side of the conveyor, the guide including a plurality of generally L-shaped guide sections, one arm of each L-shaped guide section being attached to said conveyor and the other arm of each guide section extending toward the face to be won; a drive frame at each end of the conveyor; a plough drive chain passing around a pair of end sprockets positioned at the goaf-side of the conveyor, each sprocket being associated with a respective one of the drive frames; a plough movable in the direction of the conveyor, the plow being formed with guide surfaces which cooperate with the guide, the plough having a plough body provided with cutters at one end thereof, and with a sword plate which passes underneath the conveyor, the sword plate having a coupling member which engages the plough drive chain and which is set back relative to the cutters by a sufficient distance to enable the plough to win material up to the appropriate end sprocket when the plough is moving in such a direction that the cutters are leading cutters.

2. An installation according to claim 1, wherein the plough includes two longitudinally-spaced plough bodies each of which is provided with cutters at one end thereof, each plough body being provided with a sword plate which passes underneath the conveyor, and each sword plate being provided with a coupling member for engaging the plough drive chain, the two coupling members being adjacent to one another and being interconnected, wherein each coupling member is set back relative to the cutters of its plough body by a sufficient distance to enable the plough to win material up to the appropriate end sprocket when the plough is moving in such a direction that said cutters are leading cutters.

3. An installation according to claim 2, wherein one plough body, sword plate and coupling member combination is a mirror-image of the other plough body, sword plate and coupling member combination.

4. An installation according to claim 1, wherein the sword plate extends over only part of the length of its plough body, and is spaced from the cutters of its plough body.

5. An installation to claim 4, wherein the sword plate tapers from its plough body towards its coupling member.

6. An installation according to claim 2, wherein each sword plate extends over only part of the length of its plough body, and is spaced from the cutters of that plough body.

7. An installation according to claim 6, wherein each sword plate tapers from its plough body towards its coupling member.

8. An installation according to claim 1, wherein the coupling member is set back relative to the cutters of its plough body by a distance which is greater than the distance between the appropriate end sprocket and the free end of its drive frame.

9. An installation according to claim 1, wherein the guide is formed with a guide passage which opens out towards the floor of the working, the guide passage being formed by recesses in the guide sections, the recesses being formed at the apices of the guide sections.

10. An installation according to claim 9, wherein the plough body is provided with at least one guide element which engages in the guide passage.

11. An installation according to claim 10, wherein the plough body is provided with two guide elements which engage in the guide passage, the two guide elements being positioned at the ends of the plough body.

12. An installation according to claim 1, wherein the plough guide is provided with an upwardly-extending projection, and the plough body is shaped to engage around this projection.

13. A mineral mining installation for winning material in a longwall working, comprising: a longwall conveyor; a guide provided at the face-side of the conveyor, the guide including a plurality of L-shaped guide sections, one arm of each L-shaped guide section being attached to said conveyor and the other arm of each guide section extending towards the face to be won; a drive frame at each end of the conveyor; a drive chain passing around a pair of end sprockets positioned at the goaf side of the conveyor, each sprocket being associated with a respective one of the drive frames; a plough movable in the direction of the conveyor, the plough being formed with guide surfaces which cooperate with the guide, said plough including two longitudinally spaced plough bodies each of which is provided with cutters at one end thereof, each plough body being provided with a sword plate which passes underneath the conveyor, each sword plate being provided with a coupling member for engaging the drive chain, the two coupling members being adjacent to one another and being interconnected, each coupling member being set back relative to the cutters of its plough body by a sufficient distance to enable the plough to win material up to an appropriate end sprocket when the plough is moving in such a direction that said cutters are leading cutters.

14. An installation according to claim 13, wherein each coupling member is set back relative to the cutters of its plough body by a distance which is greater than the distance between the appropriate end sprocket and the free end of its drive frame.

15. An installation according to claim 13, wherein the guide is formed with a guide passage which opens out towards the floor of the working, the guide passage being formed by recesses in the guide sections, the recesses being formed at the apices of the guide sections.

16. An installation according to claim 15, wherein each plough body is provided with at least one guide element which engages in the guide passage.

17. An installation according to claim 16, wherein each plough body is provided with two guide elements which engage in the guide passage, the two guide elements being positioned at the ends of that plough body.

18. An installation according to claim 13, wherein the plough guide is provided with an upwardly-extending projection, and each plough body is shaped to engage around this projection.

19. An installation according to claim 1, or 13, wherein the plough guide extends over the entire length of the conveyor and over substantially the entire length of each of the drive frames.

* * * * *